United States Patent [19]

Hartmann

[11] Patent Number: 4,512,738

[45] Date of Patent: Apr. 23, 1985

[54] HIGH-TEMPERATURE KILNS

[75] Inventor: Michel Hartmann, Hericourt, France

[73] Assignee: Societe d'Etudes et de Constructions Electriques et Mecaniques Secem, Paris, France

[21] Appl. No.: 549,184

[22] Filed: Nov. 4, 1983

[30] Foreign Application Priority Data

Nov. 19, 1982 [FR] France ..... 8219402

[51] Int. Cl.[3] ..... F27D 1/00; F23M 5/06

[52] U.S. Cl. ..... 432/247; 110/332; 432/251

[58] Field of Search ..... 110/332, 331; 432/247, 432/250, 251

[56] References Cited

U.S. PATENT DOCUMENTS 1,266,745 5/1918 Wundrack ..... 110/332

FOREIGN PATENT DOCUMENTS 473933 3/1929 Fed. Rep. of Germany ..... 110/331
3030714 2/1982 Fed. Rep. of Germany ..... 432/249
466811 5/1914 France ..... 432/251

*Primary Examiner*—John J. Camby

*Attorney, Agent, or Firm*—Darby & Darby

[57] ABSTRACT

This invention relates to high-temperature kilns such as those used for baking ceramic products. It relates more particularly to the design and construction of the roof of such kilns. According to this invention, the roof (1) is flat and is composed of bricks (4) placed side-by-side which are permanently pressed together by resilient means (16) resting against a rigid external structure (12). The roof bricks (4) are provided with narrow notches (5–9). The combined effect of these notches with the lateral thrust from the springs (16) gives rise within the roof (1) to an arcuate orientation of prestressing forces, so that the flat roof (1) offers a mechanical resistance which matches the resistance of an arched vault, without having the drawbacks of a conventional arched structure, in which the inner volume of the arch is practically useless and causes an uneven heat distribution. This invention thus achieves a flat roof structure which does away with the need for suspension means, and is much more gas-tight than conventional types of flat roofs. Preferably, the springs (16) used for pressing the roof bricks (4) together are located outside the external steel casing (12), so that they are not affected by heat.

11 Claims, 5 Drawing Figures

HIGH-TEMPERATURE KILNS

This invention relates to the design and construction of high-temperature kilns, such as those used for baking ceramic products, and more particularly to the design and construction of the ceiling or top wall of such kilns.

The main purpose of this invention is to achieve a kiln structure with a substantially flat ceiling which will be free of the drawbacks associated with conventional designs of flat ceilings as well as of those of arched vault structures.

A further purpose is to achieve a flat ceiling which may be as strong as an arched vault, while being extremely gas-tight and easy to assemble, and preserving the advantage of a flat ceiling in respect of a proper heat distribution within the kiln.

It is also an objective of this invention to achieve a flat ceiling structure which may be readily fitted with a very effective heat-insulating overlay.

BACKGROUND OF THE INVENTION

The top wall of high-temperature kilns is customarily designed as an arched vault made of refractory bricks. However, this design generates considerable lateral thrust forces which must be supported by the side walls or by a rigid external casing, and it brings about a waste of internal space, since the inner volume of the arch is of hardly any use and moreover gives rise to an uneven distribution of heat and to a stagnation of hot gases within the kiln.

It has been suggested, as a remedy to these drawbacks, to design the top wall of a kiln as a flat hanging ceiling, the bricks in this ceiling being pre-assembled in pairs over metal hooks or lugs hanging from a rigid structure erected above the ceiling at the time of final assembling. However, this design makes it difficult to ensure a proper gas-tightness of the top wall. On another hand, the metal components embedded in the brickwork must endure high temperatures, so that the strength of the ceiling is not too satisfactory. This drawback becomes even worse when a substantial heat-insulating layer is provided on top of the ceiling, since it will increase the effect of the temperature on the suspension pieces which are not cooled. Finally, these suspension components render the installation of the insulating material more difficult and costly.

Alternatively, it has also been suggested to provide the ceiling bricks with horizontal channels and to slip into these perforated bricks horizontal bars supported at intervals by metal hooks hanging from a rigid overhead structure. This design presents the same drawbacks as the first-mentioned one and is even more complicated and costly to assemble.

The purpose of this invention is to provide a design of the top wall in a high-temperature kiln which will eliminate the above-mentioned drawbacks.

SUMMARY OF THE INVENTION

This invention relates to the design and construction of high-temperature kilns, such as those used for baking ceramic products, and relates more particularly to the design and construction of the ceiling or top wall of such kilns.

The main purpose of this invention is to achieve a kiln structure with a substantially flat ceiling which may be as strong as an arched vault, while being extremely gas-tight and easy to assemble, and preserving the advantages of a flat ceiling in respect of a proper heat distribution throughout the kiln.

A further purpose of the invention is to achieve, in a high-temperature kiln of the kind considered, a flat ceiling structure which may be readily provided with a very effective heat-insulating overlay.

According to the invention, the vault or top wall of a high-temperature kiln is designed as a planar vault assembled by placing refractory bricks side-by-side and applying a resilient lateral compression thrust thereto by means of springs or equivalent resilient means resting against a rigid external structure which will support lateral stresses, while providing at intervals narrow longitudinal notches perpendicular to the lateral thrust direction in at least one of the lower and upper faces of the assembled top wall, the depth of the notches in the underface decreasing from the central region of the ceiling towards the edges while the depth of the notches in the upper face increases from the central region towards the edges.

It has been shown experimentally that the combination of this resilient lateral thrust with the above-mentioned notches results in a ceiling structure which may be as strong as an arched vault, and will also be extremely gas-tight, while its construction becomes easier. A further advantage is that the installation of a very effective heat-insulating layer can be carried out without any hindrance.

Further features of this invention will now be set forth:

(a) The lateral portions of the ceiling resting on top of the side walls of the kiln are formed of bricks, the height of which is substantially smaller than that of the bricks of the central portion of said ceiling overhanging the kiln.

(b) The maximum depth of the notches does not exceed approximately one-third of the height of the bricks.

(c) The notches in the upper face and in the underface are located in registry with one another and their combined height does not exceed approximately one-third of the height of the bricks.

(d) The distance from one notch to the adjacent one is comprised between 0.20 meter and 0.50 meter.

(e) The resilient means provided for lateral compression consist of springs or stacks of spring washers placed at intervals and operating through lateral distribution bars.

(f) The springs or spring washer stacks are located outside the insulating layer provided around the refractory brickwork and they press against the bricks through pusher rods.

(g) The rigid back-up structure against which the springs are resting consists of a casing made of ribbed steel sheet and surrounding at least the side walls and top wall of the kiln.

Further features and advantages of this invention will appear from the following detailed description, with reference to the appended drawings showing a preferred embodiment of the invention, in which.

DETAILED DESCRIPTION OF THE INVENTION

Figure 1:
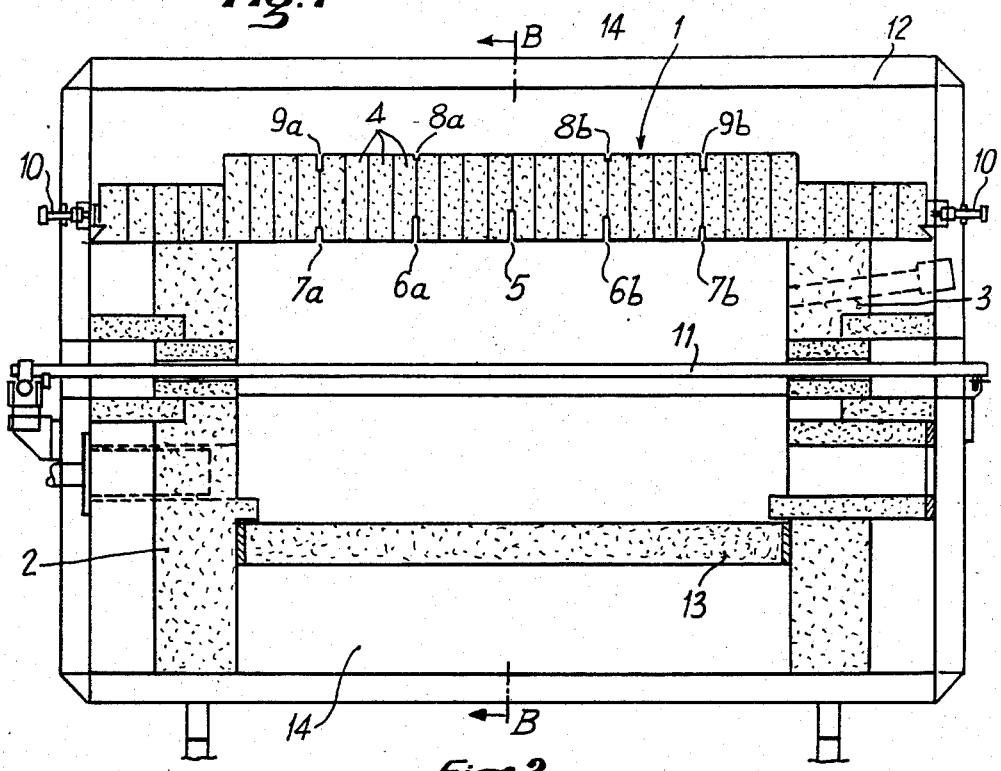
FIG. 1 is a vertical cross-section of a kiln along line A—A of FIG. 2.
Figure 2:
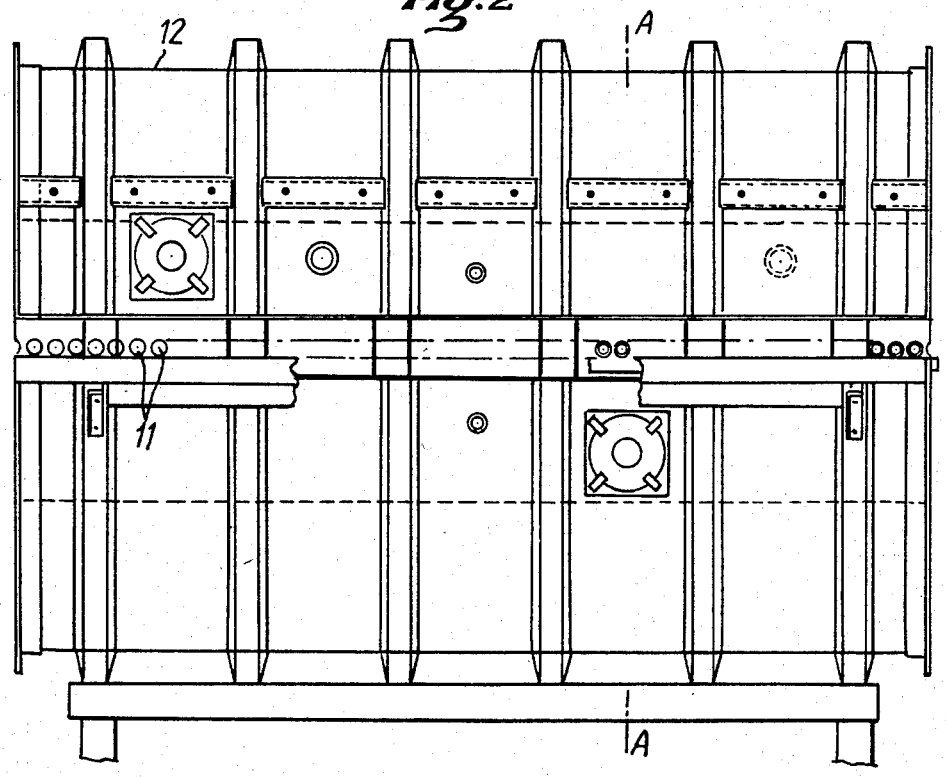
FIG. 2 is a side view of a longitudinal section of the kiln of FIG. 1.
Figure 3:
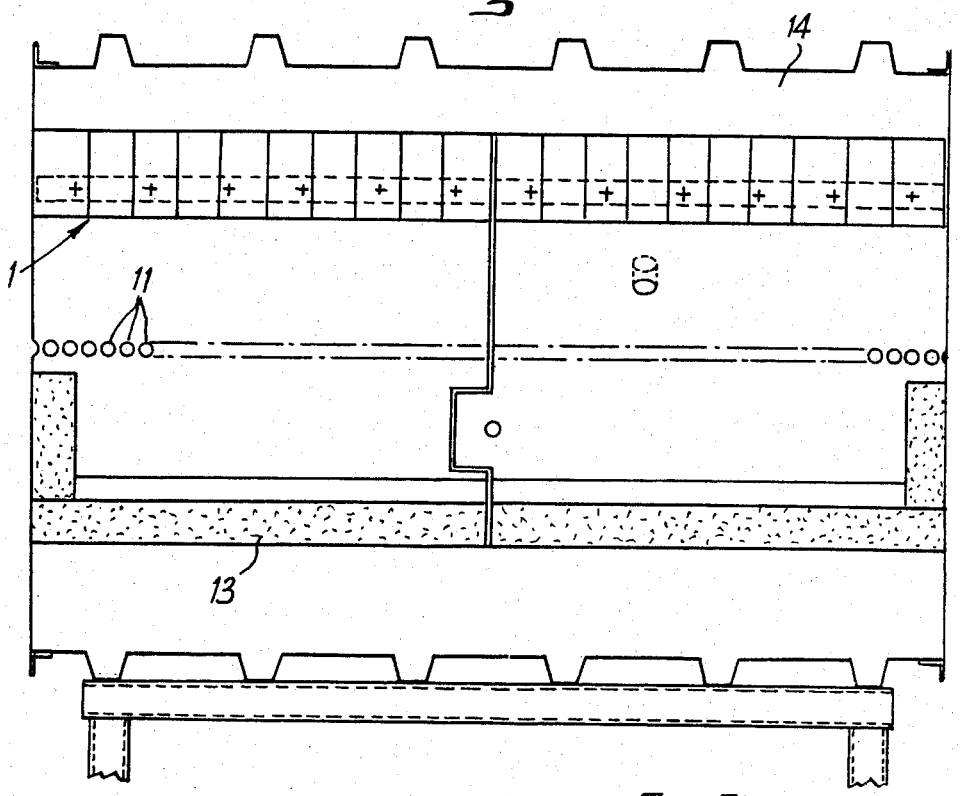
FIG. 3 is a longitudinal cross-section of this same kiln section along line B—B of FIG. 1.

Referring to FIGS. 1, 2 and 3 which illustrate a kiln of the type provided with rollers 11, the length of such a kiln being possibly from 40 meters to 60 meters or even more, it will be seen that the top wall 1 resting on the sidewalls or piers 2 and 3 has the shape of a planar vault, formed of bricks 4 laying side-by-side, which may be joined together with mortar. Bricks 4 have a rectangular profile (or cross section) as shown in FIG. 1. They may therefore be ordinary rectangular parallelipipedic bricks. These bricks are subjected to a resilient lateral pressure developed by any appropriate means, preference being given to push-rods actuated by calibrated springs 10, so that the ceiling 1 will be subject to a compression force transversal to the kiln longitudinal axis, the value of this force being predetermined and constant.

According to another feature of the invention, the bricks 4 which form the ceiling 1 are provided with narrow notches (approximately 10 mm wide) extending parallel to the longitudinal axis of the kiln. The depth of the notches in the underface (intrados) of the ceiling decreases from the central notch 5 towards the lateral notches 7*a* and 7*b*, while the depth of the notches in the upper face (extrados) increases from the central axis (where the notch depth should be zero) towards the lateral notches 9*a* and 9*b*. The number of intermediary notches, such as 6*a*, 6*b* in the underface and 8*a*, 8*b* in the upper face will depend upon the width of the kiln so that the spacing between adjacent notches may remain comprised between 0.20 meter and 0.50 meter, approximately, a preferred spacing being from 0.25 to 0.30 meter.

The combined effect of the lateral thrust developed by springs 10 and of the presence of the notches 5 to 9 gives rise, within the vault 1, to an arcuate orientation of prestressing forces, thus conferring to the vault mechanical resistance qualities matching those of an arched vault, with an extremely good gas-tightness.

For further enhancing this effect, the bricks in the lateral regions 1*a*, l*b* of the ceiling overlaying the piers 2 and 3 have a smaller height than the bricks in the central portion of the ceiling. Preferably, their height is about two thirds of that of the central portion bricks. The push-rods 10 develop their thrust at about mid-height of these lateral regions of the ceiling.

Preferably, the depth of the notches 5–9 is at most one third of the height of the bricks 4 of the ceiling 1. The notches in the upper face are respectively in registry with those in the underface and the total height of two corresponding notches in both faces is preferably not more than one third of the brick height.

Push-rods 10 are mounted in a rigid structure 12 which surrounds the side walls of the kiln. This structure may be formed of a frame of steel shapes, but preferably it should consist of an external casing 12 made of corrugated or ribbed steel plate having sufficient inertia for ensuring stability of the kiln, resistance to the weight of the brickwork and of the loads, as well as the reaction to the forces of the springs 10. This casing 12 surrounds at least the piers 2, 3 and the top wall 1 of the kiln, and preferably also the sole 13. The various parts of the casing may be welded together so as to offer a complete gas-tightness.

A layer of insulating material is provided between the brickwork 1, 2, 3, 13 and the casing 12.

The devices for guiding and driving the rollers 11, as well as the burners and exhaust stacks do not form part of this invention and may be designed in any appropriate manner.

Figure 4:
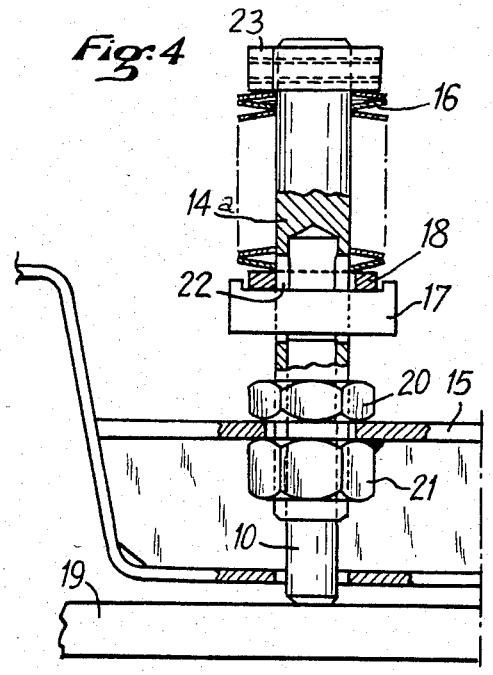
FIGS. 4 and 5 show details of the lateral thrust compensation system, shown partly in cross-section respectively perpendicular and parallel to the corrugations of the external casing of the kiln.
Figure 5:
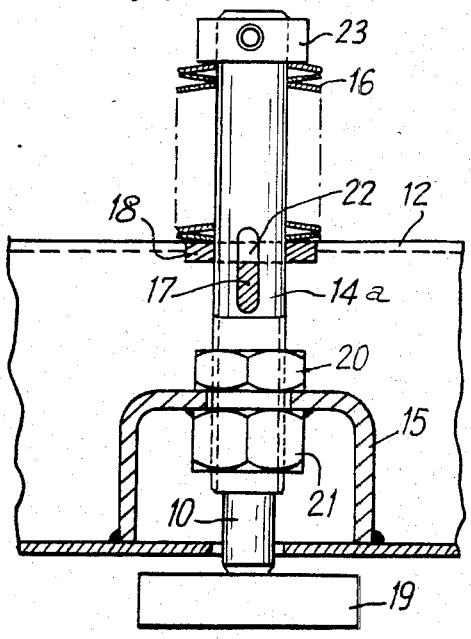

A preferred embodiment of the spring and push-rod system 10 is illustrated in FIGS. 4 and 5. This system comprises a threaded sleeve 14*a* held by nuts 20 and 21 on a supporting member 15 which is attached to the casing structure 12. The push-rod 10 is slidable inside this sleeve 14*a* and is pushed by the spring 16 which is compressed between a thrust collar 23 attached to the sleeve 14*a* and a washer 18 resting against a pin 17 slidable in a slot 22 of sleeve 14*a*. The length of this slot 22 determines the stroke of the push-rod 10. This push-rod presses against the bricks 4 through the intermediary of the spreader bar 19.

This arrangement, combined with the push-rods 10, allows for the springs 16 to be located outside the insulating layer surrounding the brickwork and even outside the external casing 12, as shown in FIG. 5, so that they are protected against the effects of temperature.

In the illustrated example, the thrust is obtained by using a stack of spring washers, but a coil spring or a jack could be used as an equivalent.

The initial setting of the prestress of the vault is obtained by adjusting nuts 20 and 21 which determine the initial compression of springs 16 and the stroke of push-rod 10.

FIGS. 1 and 3 represent a section of a kiln, the complete kiln being formed of several such sections joined together.

Whereas the invention has been described with reference to a kiln of the type equipped with rollers, it will obviously be also applicable to any other type of high-temperature kiln.

Preferably, the bricks of the ceiling will be of a superior quality, compared with the other walls, particularly in respect of heat resistance.

In the example illustrated, notches 5–9 are provided in the upper face as well as in the underface of the ceiling 1, and they are aligned in pairs. It is however possible, although the results will not be quite as good, to provide notches in only one of the faces, or to allow some extent of offset between notches in the upper and lower faces, or also to have a different number and distribution of notches on the intrados and the extrados.

What is claimed is:

1. A high-temperature kiln, having a top wall or vault formed of ceramic bricks, wherein said top wall is in the form of a planar vault, said vault being comprised of said bricks, and said bricks are refractory bricks having a rectangular profile placed side-by-side, springs resting against a rigid external structure and subjecting said bricks to a resilient lateral compression thrust from said springs, said top wall being provided at intervals with narrow longitudinal notches in at least one of its lower and upper faces, the depth of said notches in the underface decreasing from the central region of the top wall towards lateral edges of said wall while the depth of the notches in said upper face of said top wall increases from its central region towards said lateral edges.

2. A kiln according to claim 1, in which the lateral portions of the top wall (1) resting on top of the side walls of the kiln are formed of lateral bricks having a substantially smaller height than those of the central portion of said top wall overhanging the kiln.

3. The kiln according to claim 2 wherein said springs are oppositely disposed across a line positioned at substantially one-third the height of said bricks.

4. The kiln according to claim 3 wherein said lateral bricks have a height substantially equal to two-thirds the height of said central bricks.

5. A kiln according to claim 1 or claim 4, in which the maximum depth of the notches does not exceed one third of the height of the bricks, approximately.

6. A kiln according to claim 4, in which the notches (8, 9) in the upper face and the notches (5–7) in the underface of the top wall are located in registry with one another and their combined height does not exceed one third of the height of the bricks, approximately.

7. A kiln according to claim 4, in which the distance between adjacent notches is comprised between 0.20 meter and 0.50 meter.

8. A kiln according to claim 4, in which the resilient means provided for lateral compression of the roof bricks consist of springs or stacks of spring washers placed at intervals and operating through distribution bars.

9. A kiln according to claim 8, in which the springs or stacks (16) of spring washers are located outside an insulating layer provided around said refractory brickwork and press against said roof bricks through pushrods (10).

10. A kiln according to any of the above claims wherein said roof is supported on piers and has a rigid back-up structure against which said springs are abutted and further comprises a casing of ribbed steel plate which surrounds at least said piers and said roof of the kiln.

11. A kiln according to claim 10, wherein said casing forms an integral structure of welded corrugated steel plate surrounding the whole kiln, said casing offering sufficient inertia for ensuring resistance to the weight of the brickwork and of contents of said kiln, as well as its resistance to reaction of thurst from said spring provided for compressing said bricks of said kiln roof.

* * * * *